United States Patent [19]

Swan

[11] 4,099,664

[45] Jul. 11, 1978

[54] BOTTOM SECUREMENT DEVICE FOR POLYGONAL CARTON WITH BOTTOM REINFORCING RIBS

[76] Inventor: Walter B. Swan, 1400 W. 44th St., Chicago, Ill. 60609

[21] Appl. No.: 719,405

[22] Filed: Sep. 1, 1976

Related U.S. Application Data

[60] Continuation-in-part of Ser. No. 719,245, Aug. 31, 1976, which is a division of Ser. No. 601,593, Aug. 4, 1975, Pat. No. 3,977,594.

[51] Int. Cl.[2] ..... B65D 5/12

[52] U.S. Cl. ..... 229/5.7; 229/23 BT; 229/41 C; 229/39 R

[58] Field of Search ..... 229/23 BT, 41 B, 41 C, 229/41 D, 39 R, 5.5, 5.7, 5.8; 220/69

[56] References Cited

U.S. PATENT DOCUMENTS

| | | | |
|---|---|---|---|
| 2,483,464 | 10/1949 | Johnson | 229/7 R X |
| 3,000,496 | 9/1961 | Larson | 229/41 C X |
| 3,526,352 | 9/1970 | Swett | 229/39 R |
| 3,563,448 | 10/1969 | Croley | 229/23 BT |
| 3,901,431 | 8/1975 | Carlson | 229/41 C X |
| 3,941,300 | 3/1976 | Troth | 229/5.5 |
| 3,977,594 | 8/1976 | Swan | 229/39 R |

FOREIGN PATENT DOCUMENTS

| | | | |
|---|---|---|---|
| 158,551 | 8/1954 | Australia | 229/41 C |

*Primary Examiner*—Davis T. Moorhead
*Attorney, Agent, or Firm*—Cook, Wetzel & Egan, Ltd.

[57] ABSTRACT

The bottom securement device is utilized with a polygonal carton constructed from unitary blank of material and having a plurality of side panels and a bottom formed from a plurality of triangularly shaped bottom panels equal in number to the side panels with each bottom panel being hingedly connected to one of the side panels and inclining upwardly from the bottom edge of the side panel to which it is connected. A reinforcing rib is hingedly interconnected between abutting side edges of adjacent bottom panels and extends generally downwardly from the abutting edges of the adjacent bottom panels. The securement device can take one of several forms and is designed to engage the reinforcing ribs thereby to secure them in place and thereby secure the bottom panels in place. One securement device comprises an annular ring which is received in slots in the reinforcing ribs. Another securement device is disc shaped with a plate portion and protrusions projecting upwardly from the plate portion and arranged to fit between and against the reinforcing ribs to secure them and the bottom panels connected thereto in place.

6 Claims, 6 Drawing Figures

FIG. 4
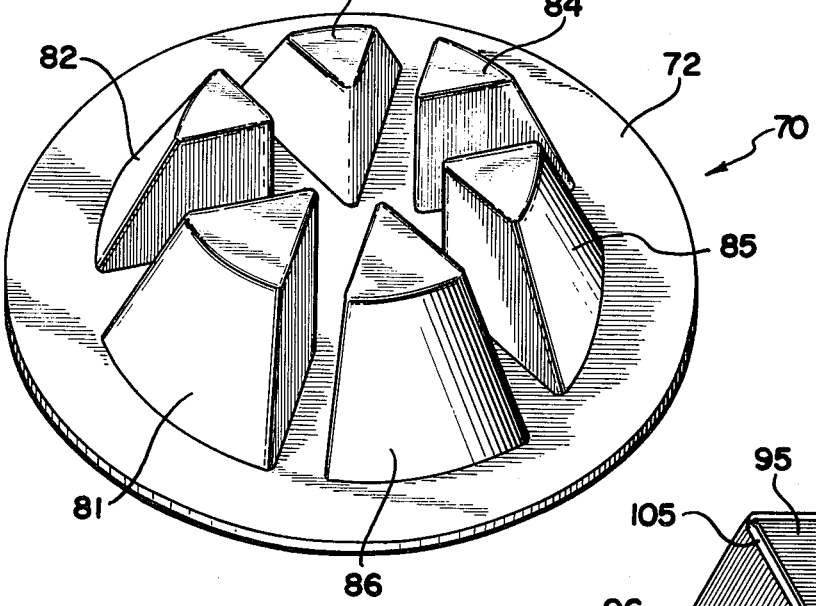
FIG. 5
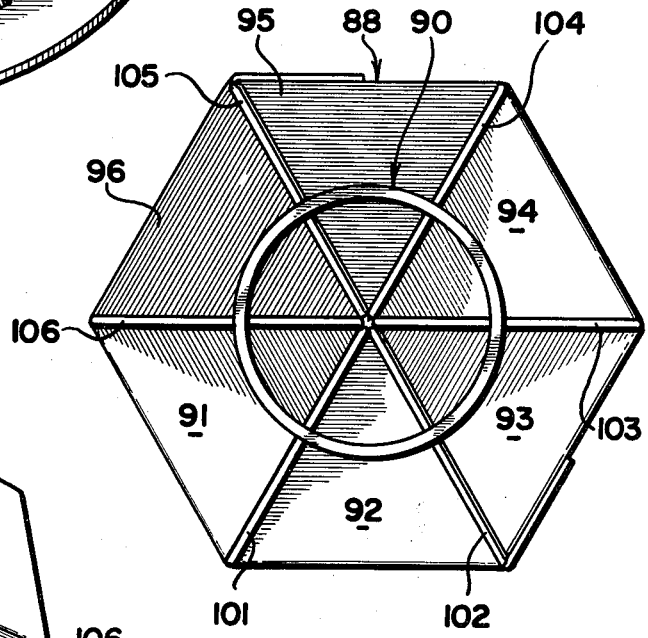
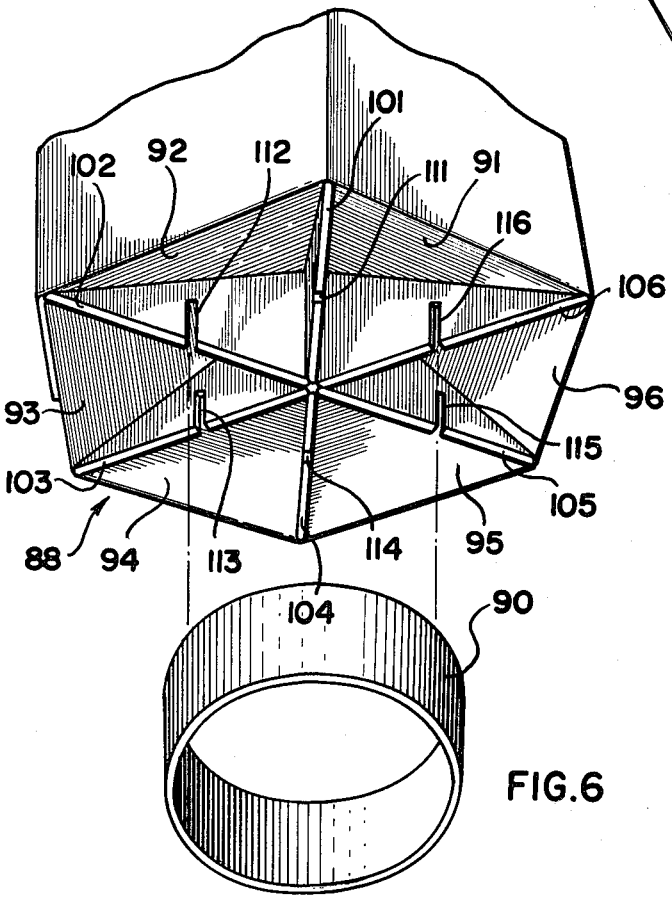
FIG. 6

BOTTOM SECUREMENT DEVICE FOR POLYGONAL CARTON WITH BOTTOM REINFORCING RIBS

CROSS-REFERENCE TO RELATED APPLICATION

This application is a continuation-in-part of my earlier application Ser. No. 719,245, filed on Aug. 31, 1976, which in turn is a division of my yet earlier application Ser. No. 601,593, filed on Aug. 4, 1975, and now issued as U.S. Pat. No. 3,077,594.

BACKGROUND OF THE INVENTION

1. Field Of The Invention

The present invention relates to polygonal cartons and more specifically to a securement device for securing reinforcing ribs on the bottom of a polygonal carton in place. A polygonal carton having such bottom reinforcing ribs is disclosed in U.S. application Ser. No. 601,593, filed Aug. 4, 1975, and now issued to U.S. Pat. No. 3,977,594. The subject matter of this prior application Ser. No. 601,593 is incorporated herein by reference.

2. Description Of The Prior Art

Heretofore various polygonal cartons made from a unitary paperboard blank have been proposed. Also polygonal cartons and containers having a reinforced bottom have been proposed. Examples of the previously proposed polygonal cartons made from a unitary blank and/or having a reinforced bottom including reinforcing ribs are disclosed in the following patents:

U.S. Pat. No. 1,909,649
U.S. Pat. No. 2,000,210
U.S. Pat. No. 2,483,464
2,517,552
U.S. Pat. No. 2,565,182
U.S. Pat. No. 2,761,611
U.S. Pat. No. 3,000,496
U.S. Pat. No. 3,071,308
U.S. Pat. No. 3,559,871
U.S. Pat. No. 3,526,352
U.S. Pat. No. 3,700,161
U.S. Pat. No. 3,768,720
British Pat. No. 1,201,192
Canadian Pat. No. 500,929
French Pat. No. 1,559,856

In prior application Ser. No. 601,593 there is disclosed a novel polygonal carton having side panels, triangularly shaped bottom panels which incline upwardly from the side panels and reinforcing ribs interconnected to the abutting side edges of adjacent bottom panels and extending downwardly therefrom. Typically, such a carbon is made from a unitary blank of paperboard material such as double faced corrugated paperboard. Such paperboard material has a tendancy to spring back from a folded position. As a result some of the bottom constructions in polygonal cartons made in accordance with the teachings of the invention disclosed and claimed in application Ser. No. 601,593 had a tendancy to spring upwardly within the carton.

The securement device of the present invention to be described hereinafter in detail solves this problem by holding the reinforcing ribs and the bottom panels connected thereto in place.

SUMMARY OF THE INVENTION

According to the invention there is provided in a polygonal carton having a plurality of side panels and a strong, weight supporting bottom comprising a plurality of generally triangular bottom panels equal in number to the side panels and a plurality of interconnecting webs each extending between a pair of adjacent bottom panels and being folded into a reinforcing rib, each bottom panel being hingedly connected to one of the side panels and being inclined upwardly from the bottom edge of the side panel to which it is connected so as to form an acute angle therewith, the improvement comprising means for securing the ribs and the bottom panels in place.

BRIEF DESCRIPTION OF THE DRAWINGS

FIG. 4 is a perspective elevational view of another embodiment of a bottom securement device similar to the bottom securement device shown in the FIG. 3 and made in accordance with the teachings of the present invention.

FIG. 5 is a bottom view of a polygonal carton similar to the polygonal carton shown in FIG. 1 and modified to another embodiment of a bottom securement device made in accordance with the teachings of the present invention.

FIG. 6 is a exploded perspective view of the securement device and carton bottom shown in FIG. 5.

DESCRIPTION OF THE PREFERRED EMBODIMENTS

Figure 1:
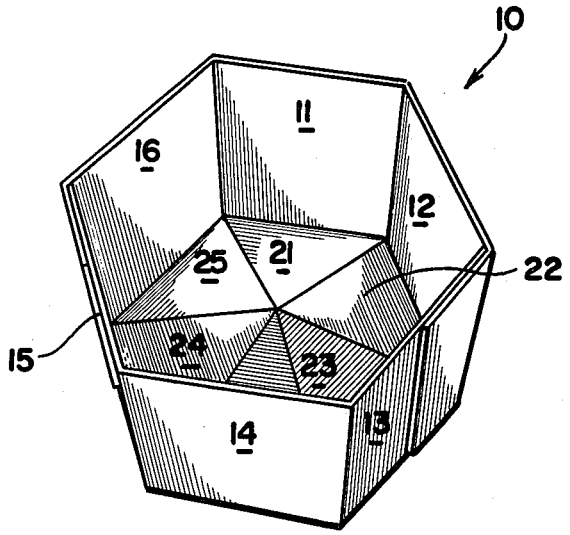
FIG. 1 is an elevational perspective view of a polygonal carton which utilizes a bottom securement device of the present invention.
Figure 2:
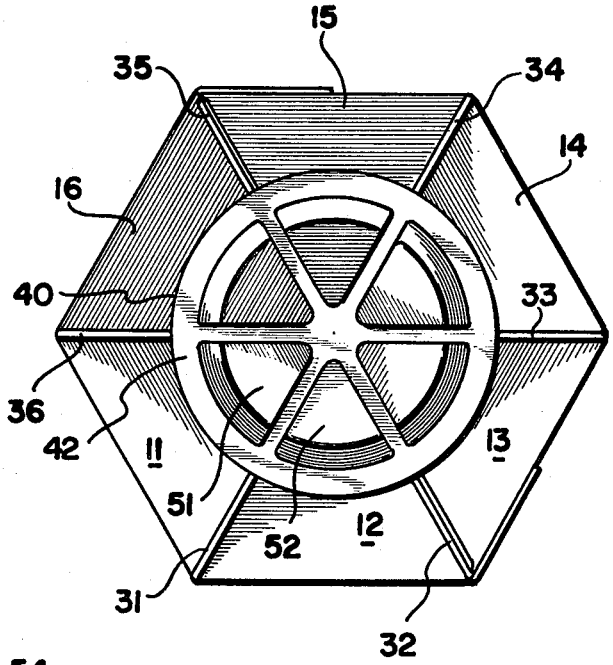
FIG. 2 is a bottom plan view of the polygonal carton shown in FIG. 1 and illustrating one embodiment of a bottom securement device made in accordance with the teachings of the present invention.

Referring now to the drawings in greater detail, a polygonal carton of the type which can utilize a bottom securement device made in accordance with the teachings of the present invention in FIG. 1 and is generally identified by reference numeral 10. The carton 10 has six sides 11–16 and a bottom including six bottom panels 21–26. Each of the bottom panels 21–26 inclines upwardly from the bottom edge of the side panel 11–16 to which it is hingedly connected. A reinforcing rib (31–36 in FIG. 2) formed from a folded web hingedly interconnected between abutting edges of adjacent side panels is provided on the underside of the bottom of the carton 10. Such reinforcing ribs are shown in FIG. 2 and generally identified by reference numerals 31–36. For further details of the construction of the carton 10, reference is made to applicants co-pending application Ser. No. 601,593 filed Aug. 4, 1975 and applicants co-pending application Ser. No. 719,435, filed Sept. 1, 1976, the subject matters of which are incorporated herein by reference.

Figure 3:
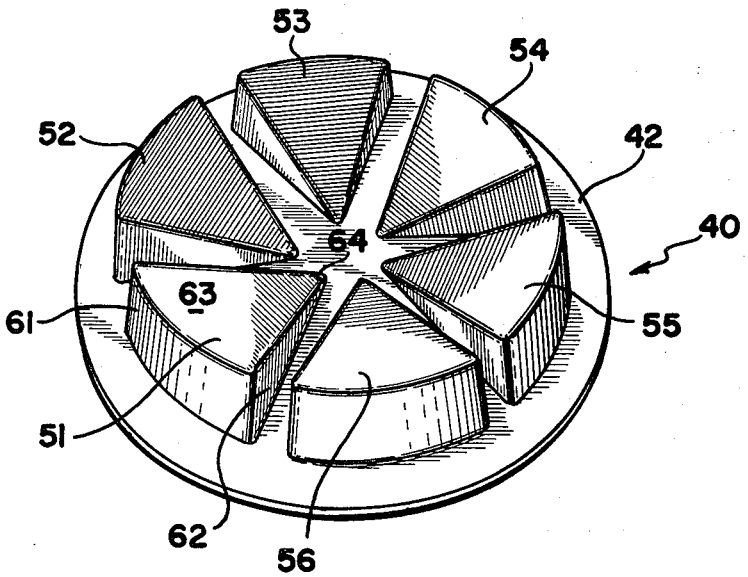
FIG. 3 is a elevational perspective view of the bottom securement device shown in FIG. 2 separated from the carton shown in FIG. 1.

The ribs 31–36 and the bottom panels 11–16 hingedly connected thereto are held in place by a bottom securement device 40 made in accordance with the teachings of the present invention. As best shown in FIG. 3, the bottom securement device 40 includes a plate portion 42 having six protrusions 51–56 projecting from the upper surface of the plate portion 42. Each of the protrusions 51–56 has a generally triangular cross section. More specifically, the cross section of each protrusion 51–56 is generally in the shape of a sector of a circle.

Since all the protrusions are essentially the same only one of them, protrusion 51, will be described in detail. As shown, protrusion 51 has a arcuate side surface 61 which inclines upwardly from the upper face of the plate portion 42. In this respect, the arcuate side surface 61 as well as the arcuate side surfaces of the other protrusions 52–56 generally lie in an imaginary conical envelope. The protrusion 51 has two planar side surfaces one of which is shown in FIG. 3 and identified by reference numeral 62. Additionally, each protrusion 51 has a generally triangular planar top surface 63 which inclines downwardly from arcuate side surface 61 to an apex 64 in the central area of plate portion 42.

As shown in FIG. 3, the protrusions 51–56 are spaced apart with the space or slot between adjacent pairs of protrusions 51–56 being configured and dimensioned to receive therebetween one of the ribs 31–36. In this way, the securement device 40 can be inserted on the bottom of the polygonal carton 10 with each of the ribs 31–36 being received in one of the slots or spaces formed between the protrusions 51–56 for securing the reinforcing ribs 31–36 and the bottompanels 11–16 connected thereto in place.

Referring now to FIG. 4 there is illustrated therein another embodiment of a bottom securement device of the present invention, generally identified by reference numeral 70. The bottom securement device 70 has a generally disc shaped plate portion 72 and six protrusions 81–86 extending upwardly from the upper face of the plate portion 72. These protrusions 81–86 are similar to the protrusions 51–56 except that they have a higher extent or height above the upper face of plate portion 72 and each has a top surface which is generally parallel to the plane of plate portion 72. In other words, the top surfaces of protrusions 81–86 do not incline downwardly as do the upper surfaces, e.g., surfaces 63, of the protrusions 51–56. In this way the side surfaces of the protrusions 81–86 have a greater extent than the side surfaces, e.g., side surface 62, of the protrusions 51–56. In other respects the securement device 70 is very similar or the same as the securement device 40. The securement device 70 has the advantage that the slots or spaces established between the protrusions 81–86 are larger and have a greater extent upwardly from the upper face of the plate portion 72. In this way the side surfaces of the protrusions 81–86 will engage a greater surface area of the ribs 31–36 then is engaged by the side surfaces, e.g., surface 62, of the protrusions 51–56.

Preferably the securement devices 40 and 70 are made from an inexpensive plastic material and molded in a known manner or formed from discs of inexpensive plastic material with the protrusions 51–56 being extruded.

Referring now to FIG. 5 there is illustrated therein the bottom of a carton 88 adapted to receive another embodiment of the securement device of the present invention generally identified by reference numeral 90. The bottom of the carton 88 has six bottom panels 91–96 and six reinforcing ribs 101–106 which are substantially the same as bottom panels 11–16 and ribs 31–36.

As best shown in FIG. 6 the securement device 90 is essentially an annular ring which can be made of inexpensive materials such as a paper, fiber or plastic. Also it will be apparent from FIG. 6 that each of the ribs 101–106 has a slot 111–116 therein to form a generally cylindrical envelope within which the securement device or annular ring 90 is received for securing the ribs 101–106 and the bottom panels 91–96 connected thereto in place.

It is to be understood that a carton of the type disclosed in the co-pending applications identified above will function adequately as described in those applications. However, because of the tendancy of the bottom panels to spring upwardly after a blank has been folded into the carton 10 or the carton 88, the bottom securement device ensures that the ribs and bottom panels will stay in place thereby to provide an improved carton over the carton disclosed in the co-pending applications referred to above.

The bottom securement device of the present invention has the advantage of holding the reinforcing ribs and bottom panels of a particular type of polygonal carton in place as described above. Other advantages are inherent in the bottom securement device and will be apparent to those skilled in the art. Also as is apparent from the three embodiments of the bottom securement device described above, obvious modifications and variations ca be made to the bottom securement device without departing from the teachings of the present invention. Accordingly, the present invention is only to be limited as necessitated by the accompanying claims.

I claim:

1. In a polygonal carton having a plurality of side panels and a strong, weight supporting bottom comprising a plurality of generally triangular bottom panels equal in number to the side panels and a plurality of interconnecting webs each extending between a pair of adjacent bottom panels being hingedly connected to one of the side panels and being inclined upwardly from the bottom edge of the side panel to which it is connected so as to form an acute angle therewith, the improvement comprising:

a device for engaging the reinforcing ribs on the bottom of said carton to secure them in place thereby also to secure the bottom panels in place, said device being generally disc shaped with a plate portion and protrusions extending upwardly from one side of said plate portion, said protrusions being configured and dimensioned to be received between adjacent ribs for holding and securing the ribs in place.

2. The securing means according to claim 1 wherein each protrusion of said device has a generally triangular cross section.

3. The securing means according to claim 1 wherein each said protrusions has a cross section generally in the shape of a sector of a circle has an arcuate side surface, two generally planar side surfaces generally perpendicular to the plane of said plate portion and an upper surface which tapers downwardly from and inwardly of said arcuate side surface toward the center of said plate portion.

4. The securing means according to claim 1 wherein each said protrusion has a cross section generally in the shape of a sector of a circle, an arcuate side surface which tapers upwardly and inwardly of said plate portion, a generally flap top surface generally parallel spaced from the plane of said plate portion and two generally planar side surfaces which are generally perpendicular to the plane of said plate portion.

5. In a polygonal carton having a plurality of side panels and a strong, weight supporting bottom comprising a plurality of generally triangular bottom panels equal in number to the side panels and a plurality of interconnecting webs each extending between a pair of adjacent bottom panels and being folded into a reinforcing rib, each reinforcing rib having a slot therein, each bottom panel being hingedly connected to one of the side panels and being inclined upwardly from the bottom edge of the side panel to which it is connected so as to form an acute angle therewith, the improvement comprising:

a device for engaging the reinforcing ribs on the bottom of said carton, said device being annular in shape and configured and dimensioned to be received in the slots for securing the ribs and the bottom panels in place.

6. A polygonal carton having a plurality of side panels and a strong weight supporting bottom formed by a plurality of generally triangular bottom panels equal in number to said side panels and a plurality of interconnecting webs, each web extending between a pair of adjacent bottom panels, each said bottom panel being hingedly connected to one of said side panels, being inclined upwardly from the bottom edge of the side panel to which it is connected so as to form an acute angle therewith, having two side edges which abut adjacent side edges of adjacent bottom panels and having said webs on either side thereof hingedly connecting said bottom panel to an adjacent bottom panel, whereby a load wich is placed on said bottom and which urges said bottom panels downwardly will be supported by the locking and bearing engagement between said abuting edges of said bottom panels and by said interconnecting webs, each said web having a fold line therein which divides said web into two rib sections and which is folded approximately 180° at said fold line to form a double ply reinforcing rib, and means in connection with the ribs and bottom panels for securing the ribs and bottom panels in place.

* * * * *

UNITED STATES PATENT OFFICE

CERTIFICATE OF CORRECTION

PATENT NO. : 4,099,664

DATED : July 11, 1978

INVENTOR(S) : Walter B. Swan

It is certified that error appears in the above-identified patent and that said Letters Patent are hereby corrected as shown below:

Column 1, line 10, "3,077,594" should be -- 3,977,594 --.

Column 4, line 24, "ca" should be -- can --.

Column 6, line 10, "wich" should be -- which --.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*